US008646294B1

(12) United States Patent
Derman

(10) Patent No.: US 8,646,294 B1
(45) Date of Patent: Feb. 11, 2014

(54) SECUREMENT LOCKING DEVICE

(71) Applicant: Jay S. Derman, Palos Verdes Peninsula, CA (US)

(72) Inventor: Jay S. Derman, Palos Verdes Peninsula, CA (US)

( * ) Notice: Subject to any disclaimer, the term of this patent is extended or adjusted under 35 U.S.C. 154(b) by 0 days.

(21) Appl. No.: 13/854,042

(22) Filed: Mar. 29, 2013

Related U.S. Application Data

(60) Provisional application No. 61/764,743, filed on Feb. 14, 2013.

(51) Int. Cl.
*E05B 69/00* (2006.01)

(52) U.S. Cl.
USPC ..... 70/58; 70/14; 70/18; 248/551

(58) Field of Classification Search
USPC ..... 70/14, 57, 58, 18; 248/551–553
See application file for complete search history.

(56) References Cited

U.S. PATENT DOCUMENTS

| | | | | | |
|---|---|---|---|---|---|
| 3,410,122 | A * | 11/1968 | Moses | 70/58 |
| 3,826,115 | A * | 7/1974 | Davis | 70/258 |
| 5,052,198 | A * | 10/1991 | Watts | 70/58 |
| 5,836,183 | A * | 11/1998 | Derman | 70/58 |
| 6,125,669 | A * | 10/2000 | McDaid et al. | 70/58 |
| 6,216,499 | B1 * | 4/2001 | Ronberg et al. | 70/58 |
| 6,308,928 | B1 * | 10/2001 | Galant | 248/553 |
| 6,427,499 | B1 * | 8/2002 | Derman | 70/58 |
| 6,443,417 | B2 * | 9/2002 | Galant | 248/553 |
| 6,484,544 | B1 * | 11/2002 | Wing | 70/227 |
| 6,560,710 | B1 * | 5/2003 | Leyden et al. | 726/34 |
| 6,763,690 | B2 * | 7/2004 | Galant | 70/58 |
| 7,007,912 | B1 * | 3/2006 | Giuliani et al. | 248/552 |
| 7,174,752 | B2 * | 2/2007 | Galant | 70/58 |
| D559,076 | S * | 1/2008 | Allen | D8/330 |
| 7,315,443 | B2 * | 1/2008 | Allen | 361/679.55 |
| 7,324,333 | B2 * | 1/2008 | Allen | 361/679.55 |
| 7,357,206 | B2 * | 4/2008 | Fobean | 180/68.5 |
| 7,576,981 | B2 * | 8/2009 | Kuo | 361/679.59 |
| 7,611,119 | B2 * | 11/2009 | Rossini | 248/551 |
| 7,658,363 | B2 * | 2/2010 | Meyer | 248/551 |
| 8,061,164 | B2 * | 11/2011 | Johnston et al. | 70/58 |
| 8,139,356 | B2 * | 3/2012 | Allen | 361/679.57 |
| 8,413,943 | B1 * | 4/2013 | Li | 248/454 |
| 8,456,836 | B2 * | 6/2013 | Allen et al. | 361/679.57 |
| 2011/0185776 | A1 * | 8/2011 | Mahaffey et al. | 70/58 |

* cited by examiner

*Primary Examiner* — Suzanne Barrett
(74) *Attorney, Agent, or Firm* — Aaron P. McGushion

(57) ABSTRACT

A securement system is provided that permits the secured locking of an ultra-portable laptop computer without requiring the use of a universal security slot. The system includes an edge member that has a body channel intersecting a screen channel formed on a face. When the laptop is open, the edge of the laptop screen fits within the screen channel and the edge of the laptop body fits within the body channel, with the edge member being positioned astride the hinge between the screen and body. A cross member connects the edge member to an opposite edge member engaged over the opposite edge of the laptop. When secured, the system cannot be removed from the laptop, since the two edge members are prevented from movement due to the cross member and the channels.

5 Claims, 5 Drawing Sheets

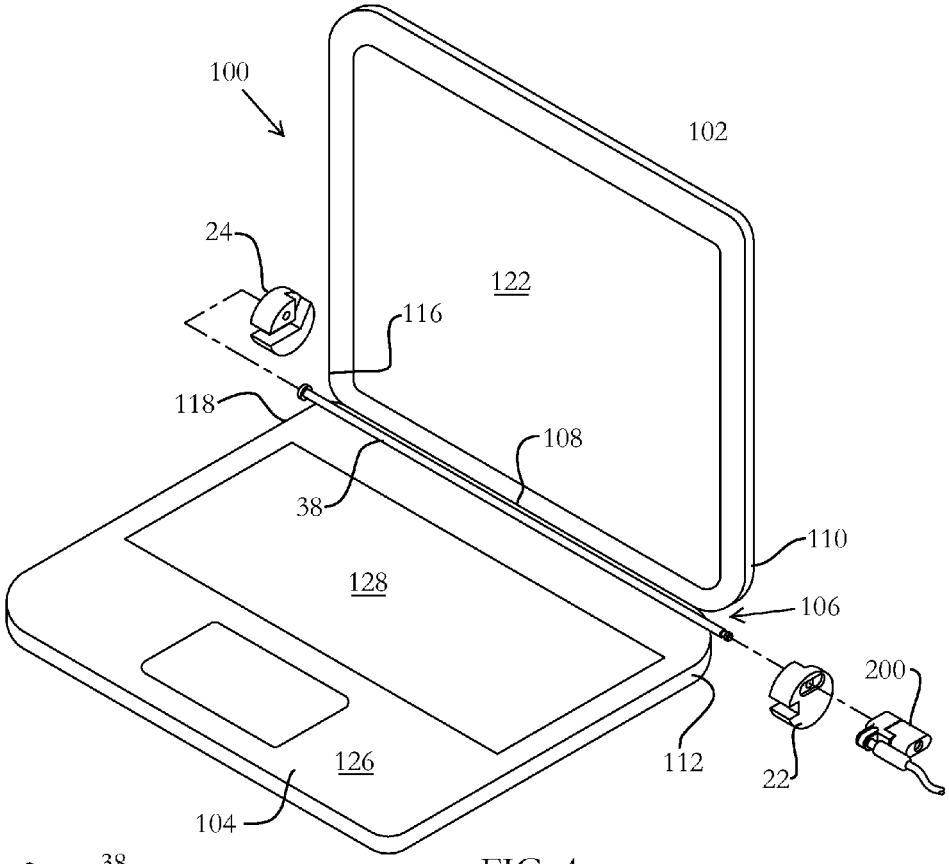
FIG. 4
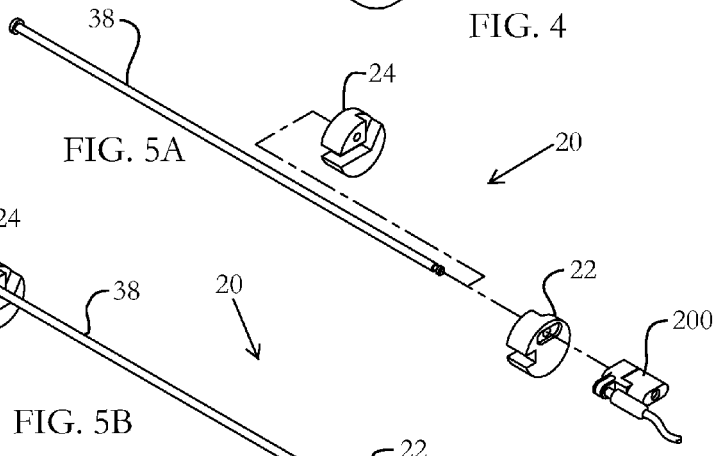
FIG. 5A
FIG. 5B

SECUREMENT LOCKING DEVICE

RELATED APPLICATION DATA

This application claims the priority date of provisional application No. 61/764,743 filed on Feb. 14, 2013.

BACKGROUND

The field of the present device and method relates to a lock for electronic devices, and more particularly, to a lock that that attaches to a portable electronic devices without engagement to a universal security slot.

It has become standard practice in the computing industry to include a universal security slot on portable electronic devices, more particularly, in computing devices such as laptops and the like. A universal security slot is an elongated hole formed through the plastic housing of an electronic device, and into a relatively large internal cavity. A small metal backing panel with a matching slot is provided on the inside wall of the housing, such that a rotating T-bar lock can be inserted through the slot and rotated into an interference engagement within the cavity of the slot. The metal backing provides additional strength to the slot structure. Alternately, a shaft retainer lock can be used with the universal security slot through an adapter nub having a T-bar on one end and an annular retaining groove on the other end of the adapter nub. The T-bar end is inserted into the universal security slot and tightened, allowing the adapter nub retaining groove end to protrude from the housing. In this way, the shaft retainer lock (sold under the name CLICKSAFE) can be engaged to the adapter nub.

Although currently a universal security slot is provided on a great majority of laptops and similar electronic devices, there are some inherent disadvantages that prevent its use in segments of the computing industry. First, laptops are being designed to reduce the overall height of the side profile of the laptop. Since use of the universal security slot relies on a relatively large internal cavity with metal-plate reinforcement, there is not sufficient space for this on a thin laptop. For example, the standard design requires the cavity to be about 10 mm×12 mm, with a minimum depth of about 7 mm. Second, it is not recommended to design a laptop with the universal security slot located close to electronic components or cooling vents. This is because the metal backing or the T-bar may contact or create interference with nearby electronic components and the lock head may block the cooling vents when attached. Third, even with the metal backing, a thief can pry the lock from engagement with the universal security slot, thus breaking the computer housing. Although the housing is damaged, the computer is still useful and the data accessible to the thief.

Attempts to address the problem of locking thin computing devices to an anchor by a tether have not wholly succeeded. Some devices include a plate that is adhered to the housing to provide a lock connection point. Users may be reluctant to glue a disk to the device; glue is seldom strong enough to resist forceful prying. Other devices are bulky and are not portable, making them useful only in securing the computer to a permanent work station. Accordingly, what is needed is a means to attach a lock to an electronic device without engagement to a universal security slot. The device should also be lightweight and portable, yet able to resist persistent theft attempts. Further, the device should allow quick and easy installation without permanent modification or damage to the computer.

SUMMARY

The present securement system provides a unique device for securing and locking portable devices, such as laptops computers, without the need for specialized and space-consuming lock attachment points on the laptop case. The present system can be made of lightweight materials, such as aluminum and high-strength plastics. Further, the present system has few parts and can be easily attached and removed from the laptop, enhancing security and portability.

A system for securing a portable device is provided, where the portable device has a screen connected to a body at a hinged joint. The system is primarily comprised of an edge member, a second edge member, and a cross member. The edge member has a body channel and a screen channel formed on an inner face, where the body channel intersects the screen channel. Further, the body channel is configured to receive the body edge and the screen channel is configured to receive the screen edge. The second edge member is configured to engage an opposite edge and optionally can have a second body channel intersecting a second screen channel configured to receive the opposite body edge and opposite screen edge respectively. The cross member is configured to selectively connect the edge member to the second edge member. A secured mode is selected when the edge member is engaged over the body edge and the screen edge, the second edge member is engaged over the opposite edge, and the edge member is securely connected to the second edge member through the cross member. In the secured mode, substantial separation of the edge member from the second edge member is prevented to substantially prohibit unauthorized removal of the system from the portable device.

Optionally, the system, and in particular the cross member, may include a lock attachment portion to prevent unauthorized disassembly of the system in the secured mode. The lock attachment portion can be an annular groove configured to receive a shaft retainer lock or a through hole that intersects the axis of the shaft and is configured to receive a shackle lock. Optionally, the cross member is a rigid beam that substantially resists bending, such that an unauthorized person is prevented from substantially bending the cross member while attempting to dislodge either the edge member or the second edge member from the secured mode. The cross member can be a rod of various cross sections, including a round cross-section and a polygonal cross-section, for example, a seven sided rod. The cross member optionally has a non-marring coating to protect the portable device from damage.

The cross member rod can have a head on one end and a lock attachment portion on the opposite end. The edge member has a through hole formed from the first face; and the second edge member has a second through hole formed from a second inner face. The rod is inserted through the second through hole with the head preventing the rod from being pulled through. The rod thereafter inserted through the through hole, and is prevented from retraction from the through hole by the attachment of a lock to a lock attachment portion. In one embodiment, the screen channel intersects the body channel at an intersection, and the screen channel increases in width from the intersection to an outer perimeter of the edge member. In this way, the screen channel provides clearance to permit a user to adjust the screen angle relative to the body.

Optionally, the body has an upper surface with a keyboard and the screen has a front surface with a display, where in the secured mode, the cross member is configured to extend from the edge member to the second edge member in the region located between upper surface and the front surface. Again optionally, a lanyard may be provided for anchoring the system and portable device to an anchor point when in the secured mode, where the lanyard can be a cable, chain, rope, or any other suitable means to secure the device. In another embodiment, a cutout may be made through either edge member for providing clearance to permit access to a data or power port on the body edge.

In an embodiment, the edge member has an L-shaped groove formed on an inner face, where the L-shaped groove is configured to receive the screen edge within a vertical portion of the L-shaped groove and the body edge within a horizontal portion of the L-shaped groove when the screen is in the open position. The vertical portion has a width sufficient to permit the adjustment of the screen angle relative to the body. The depth of the vertical portion may be slightly greater than the depth of the horizontal portion to permit the screen to be adjusted without rubbing or interference. In a secured mode, the edge member is engaged over the body edge and the screen edge when the screen is in the open position, the second edge member is engaged over the opposite edge, and the edge member is securely connected to the second edge member through the cross member. In this way, substantial separation of the edge member from the second edge member is prevented to substantially prohibit unauthorized removal of the system from the portable device. Optionally, the second edge member has a second L-shaped groove formed on a second inner face, where the second L-shaped groove is configured to receive an opposite screen edge within a second vertical portion of the second L-shaped groove and an opposite body edge within a second horizontal portion of the second L-shaped groove when the screen is in the open position. The second vertical portion has a second width sufficient to permit the adjustment of the screen angle relative to the body.

In yet another embodiment, a securement system is provided for locking a portable device. The portable device has a screen hinged to a body at a joint; the screen has a screen edge, a front surface with a display, a back surface opposite of the front surface; and the body has a body edge, a top surface with a keyboard, and a bottom surface opposite the top surface. The system has a bracket configured to be selectively installed on the portable device over both the screen edge and the body edge. The bracket is configured to be positioned astride the joint. The bracket has a front protrusion, a back protrusion, a top protrusion, and a bottom protrusion. The system includes a second bracket that is configured to engage an opposite edge of the portable device. A cross member is provided to selectively connect the bracket to the second bracket. The front protrusion is configured to extend over the front surface and the back protrusion configured to extend over the back surface with the screen edge located between the front protrusion and the back protrusion. The top protrusion is configured to extend over the top surface and the bottom protrusion configured to extend over the bottom surface with the body edge located between the top protrusion and the bottom protrusion. A secured mode is selected when the bracket is engaged over the body edge and the screen edge when the screen is in the open position, the second bracket is engaged over the opposite edge, and the bracket is securely connected to the second bracket through the cross member. In this way, substantial separation of the bracket from the second bracket is prevented to substantially prohibit unauthorized removal of the securement system from the portable device.

BRIEF DESCRIPTION OF THE SEVERAL VIEWS OF THE DRAWINGS

FIG. 4 is an exploded perspective view of the present securement system as installed on a portable device;

FIGS. 5A-B are exploded perspective views of the present securement system;

Figure 1A:
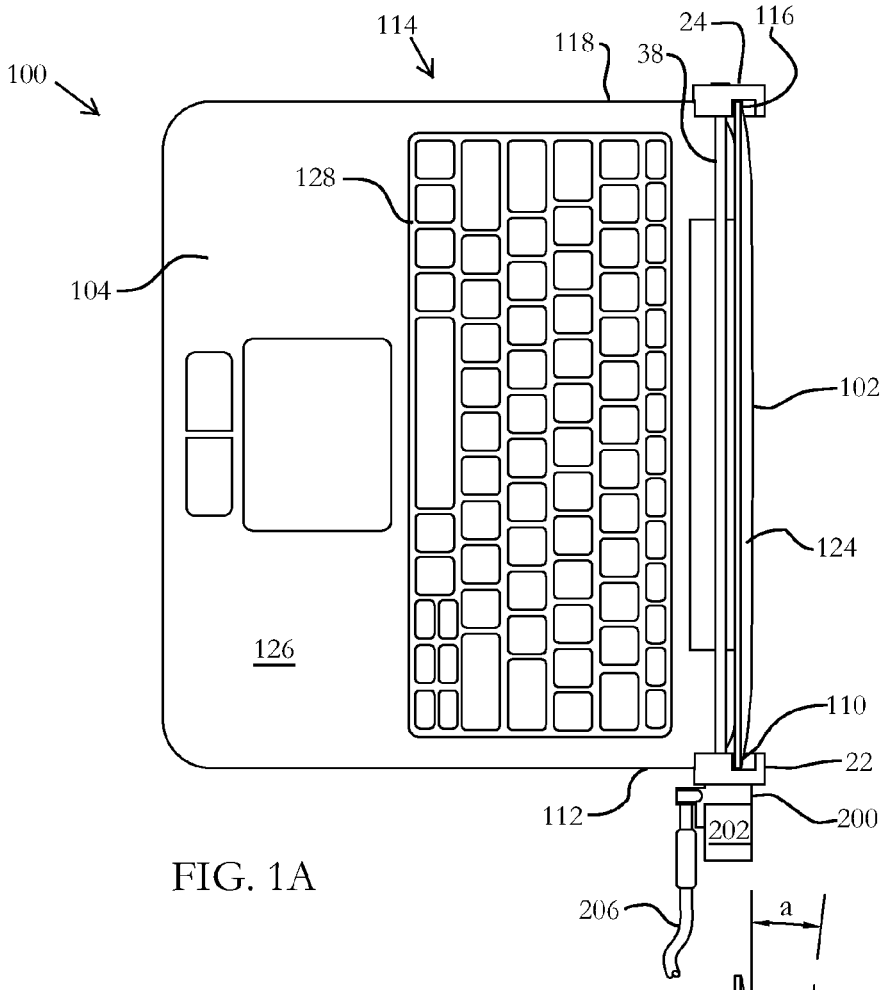
FIGS. 1A-B are orthographic views of the side and top view of the securement system of a preferred embodiment, showing the securement system securely connected to a portable device in the secured mode.

LISTING OF REFERENCE NUMERALS OF FIRST-PREFERRED EMBODIMENT securement system 20
first edge member 22
second edge member 24
L-shaped channel 26
body channel
screen channel 30
intersection 32
inner face 34
outer face 36
cross member 38
lock attachment portion 40
annular groove 42
through hole 44
cutout 46
head 48
coating 50
shackle hole 52, 52'
recess 54
countersink 56
outer perimeter 58
vertical portion 60
horizontal portion 62
front protrusion 64
back protrusion 66
top protrusion 68
bottom protrusion 70
rod 72
foot 74
Y-shaped channel 76
recessed portion 78
width w
screen angle a
depth d
portable device 100
screen 102
body 104
hinged joint 106
hinge 108
screen edge 110
body edge 112
opposite edge 114
opposite screen edge 116 opposite body edge 118
front surface 120
display 122
back surface 124
top surface 126
keyboard 128
bottom surface 130
port 132
lock 200
shaft retainer lock 202
shackle lock 204
lanyard 206
anchor point 208

DESCRIPTION OF THE PREFERRED EMBODIMENTS

The detailed descriptions set forth below in connection with the appended drawings are intended as a description of embodiments, and is not intended to represent the only forms in which the present securement system may be constructed and/or utilized. The descriptions set forth the structure and the sequence of steps for constructing and operating the securement system in connection with the illustrated embodiments. It is to be understood, however, that the same or equivalent structures and steps may be accomplished by different embodiments that are also intended to be encompassed within the spirit and scope of the invention.

Figure 1B:
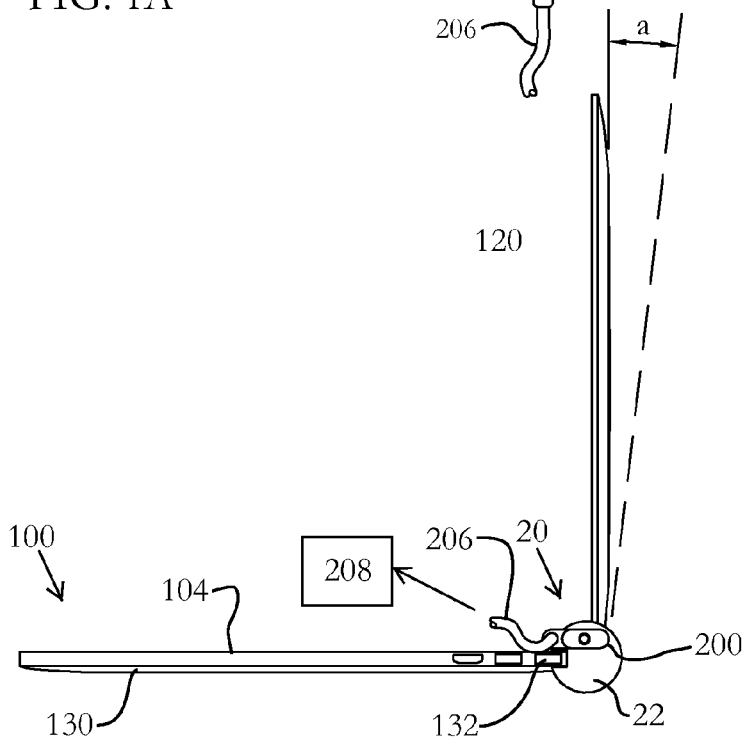

Referring to FIGS. 1A-B, a preferred embodiment of the securement system (20) is shown in the secured mode, where the securement system (20) is securely fitted to an example of a portable device (100). In this example, the portable device (100) is a laptop computer, with a screen (102) hinged to a body (104) through a hinge (108).

In particular, in the secured mode, the first edge member (22) is engaged over both the screen edge (110) and the body edge (112). In this way, the first edge member (22) is restricted from movement along or parallel to the body edge (112) by engagement with the screen edge (110). Likewise, the first edge member (22) is restricted from movement along or parallel to the screen edge (110) by engagement with the body edge (112). When the portable device (100) is in the open position, with the screen (102) opened in a substantially vertical position relative to the body (104), such that the user can view the display (122) and enter data through the keyboard (128) or other data entry means, such as a touch pad, mouse device, a capacitive touchscreen, or the like. Although the screen (102) is shown as being positioned orthogonally to the body (104), the open position includes a range of screen angles (a) that permit a user to view the display (122).

The second edge member (24) is similarly engaged over both the opposite screen edge (116) and the opposite body edge (118), with the second edge member (24) positioned astride the hinged joint (106) and aligned with the first edge member (22), which is also positioned astride the hinged joint (106). Each of the first edge member (22) and second edge member (24) have an L-shaped channel or groove (26) (as shown in greater detail when viewing FIGS. 2-3). The screen edges (110, 116) and the body edges (112, 118) are received within the L-shaped channels (26) so that the movement of the first edge member (22) and the second edge member (24) relative to the portable device (100) is prevented within a plane perpendicular to the hinge (108) axis of rotation.

In order to prevent movement of the first edge member (22) and the second edge member (24) in a direction parallel to the hinge (108) axis of rotation, a cross member (38) serves to tie or connect the first edge member (22) and the second edge member (24). The cross member (38) is inserted through the second edge member (24), spans across the width of the portable device (100), and is inserted through the first edge member (22). To securely hold the cross member (38) in place and prevent unauthorized removal of the cross member from the edge members (22, 24), a lock (200) can then be selectively connected to the cross member (38). Although a lock (200) is illustrated, many known methods can be utilized to connect the securement assembly (20) onto the portable device (100). Permanent methods of assembly include welding, gluing, riveting, and the like. Non-permanent methods of assembly include attaching a lock (200), engaging a threaded nut to the end of the cross member (38), inserting a cotter pin through the end of the cross member (38). However, a lock (200) is the preferred means to secure the system (20), since a lock prevents unauthorized disassembly, yet permits authorized disassembly by a user with a combination or key.

The lock (200) may connect the portable device (100) to an anchor point (shown schematically as box 208) through a lanyard (206). The lanyard (206) is commonly found on locks (200), such as the illustrated shaft retainer lock (202) of FIGS. 1A-B. The lanyard (206) can be a high-strength cable with a plastic sheath, a chain, a rope, or any other suitable means to secure the location of the portable device (100) and prevent its removal from a designated area. Alternatively, the lock (200) may have a rigid means of securing the location, such as a rigid metal rod or beam. The anchor point (208) can be a variety of difficult or impossible to remove objects, including walls, desks, chairs, floors, etc. For example, the user could loop the lanyard (206) through an eye bolt secured into the wall or loop the lanyard (206) about the leg of a heavy desk.

Figure 2A:
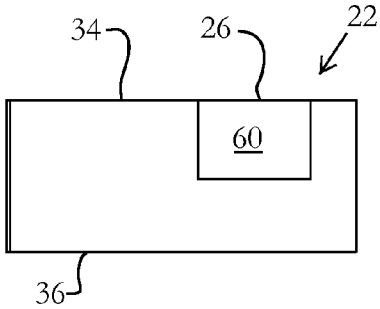
FIGS. 2A-C are orthographic views of the side and top view of the first edge member of the present securement system.
Figure 2B:
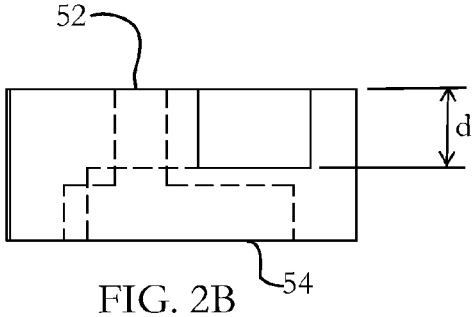
Figure 2C:
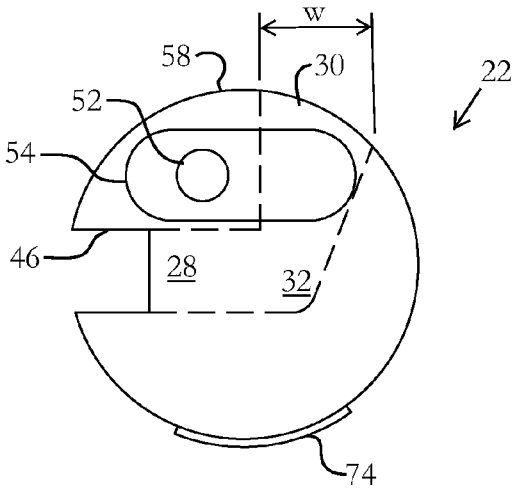

Referring now to FIGS. 2A-C and 3A-C, the first edge member (22) and the second edge member (24) are shown in plan view. The two edge members (22, 24) shown having similar features, but may be made without similarity. Although the particular example embodiment shows the second edge member (24) attached to the left side of the portable device (200) and the first edge member attached to the right, there is no mandated order of assembly and the features of one can be easily switched with the features of the other. FIGS. 2A-C show the first edge member (22), where FIG. 2A shows top view with no hidden lines shown, FIG. 2B shows the same top view, but with hidden lines representing features hidden from view, and FIG. 2C is a view from the outer face (36) with hidden lines representing features hidden from view.

FIG. 2C shows the first edge member (22) with a disk-shaped body, with sufficient thickness to receive the edge of the portable device (100) and maintain sufficient rigidity to substantially resist deformation from prying and other unauthorized uses of force to dislodge the edge member (22, 24) from the edge. A through hole (52) is provided to receive the cross member (38), which is inserted through the hole (52). A recess (54) is provided on the outer face (36) so that a shaft retainer lock (202) may engage the end of the cross member (38), with a portion of the shaft retainer lock (202) inserted into the recess (54) to prevent prying access to the space between the first edge member (22) and the shaft retainer lock (202).

On the inner face (34) of the first edge member (22) an L-shaped channel (26) is provided. Although the term "L-shaped" is used to describe the shape of the channel, with the vertical portion (60) of the channel intersecting the horizontal portion (62) of the channel at an intersection (32), there is not requirement that the channel be exactly the shape of an "L". For example, sharp corners are not required, nor a perpendicular orientation between the vertical portion (60) and the horizontal portion (62). The L-shaped channel (26) has a body channel (28) for receiving the body edge (112) and a screen channel (30) for receiving the screen edge (110). Since the screen (102) is often open a minimum of ninety degrees relative to the body (104), the screen channel (30) is substantially vertical or near vertical, presuming the body (106) is resting on a flat surface. Yet, to provide clearance for the user to open the screen (102) to angles greater than ninety degrees, the width (w) of the screen channel (30) can vary, so that the width (w) nearest to the outer perimeter (58) is wider than the width nearest to the intersection (32) of the screen channel (30) and the body channel (32). In this example, the width (w) is shown varying in a divergent manner.

The depth (d) of the L-shaped channel (26) should be sufficiently deep so that the L-shaped channel (26) overlaps a portion of the front surface (120) and the back surface (124) of the screen (102), and overlaps a portion of the top surface (126) and the bottom surface (130) of the body (104). This overlap prevents an unauthorized person from prying the edge members (22, 24) from the edges of the portable device (100).

Although a channel or groove is shown on the edge members (22, 24), a continuous channel is not required. It is just required that a front protrusion (64) extends over the front surface (120) and a back protrusion (66) extend over the back surface (124) with the screen edge (110) located between the two protrusions (64, 66). Further, a top protrusion (68) extends over the top surface (126) and a bottom protrusion (70) extend over the bottom surface (130) with the body edge (112) located between the two protrusions (68, 70). These protrusions (64, 66, 68, 70) are created in the disclosed example embodiment by cutting a groove into the edge member (22) through a milling process, molding process, or other appropriate manufacturing methods. To save on weight or material, the material in areas surrounding the protrusions (64, 66, 68, 70) could be removed, leaving just the protrusions. An alternative embodiment not shown, includes press-fitting or brazing dowels into the inner face (34) to provide the required overlap.

In order to provide clearance to permit the user access to the various data ports (132), a cutout (46) is formed through the edge member (22, 24). The data ports (132) could include USB ports, PCMCIA ports, and ports for various data cards. The cutout (46) could also provide clearance for access to a power port or to provide clearance around a cooling vent. The cutout (46) can formed by cutting a notch from the inner face (34) to the outer face (36) or by cutting a hole or opening through the edge member (22, 24). To provide a frictional engagement between the edge members (22, 24) and a table during computer use, a foot (74) made from rubber or a suitable polymer, felt, etc. is provided on the bottom of each edge member (22, 24).

Figure 3A:
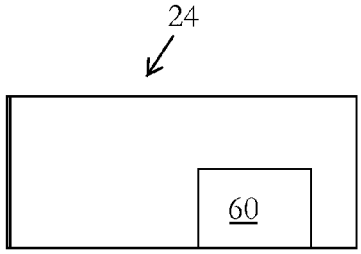
FIGS. 3A-C are orthographic views of the side and top view of the second edge member of the present securement system.
Figure 3B:
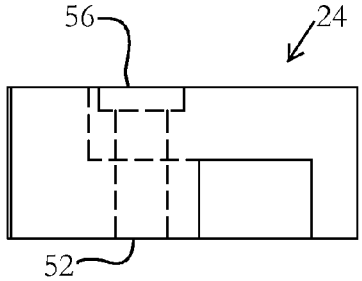
Figure 3C:
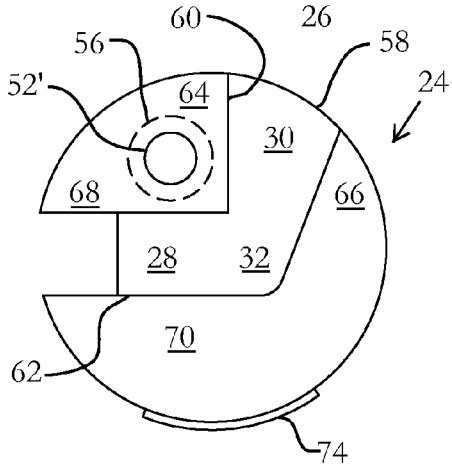
Figure 7A:
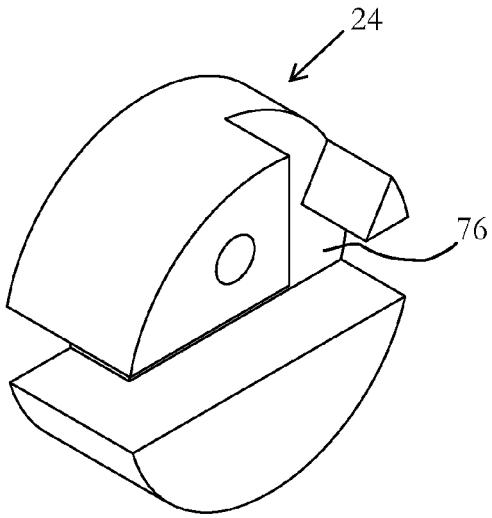
FIGS. 7A-B are perspective and orthographic views of alternate embodiments edge member of the present securement system.
Figure 7B:
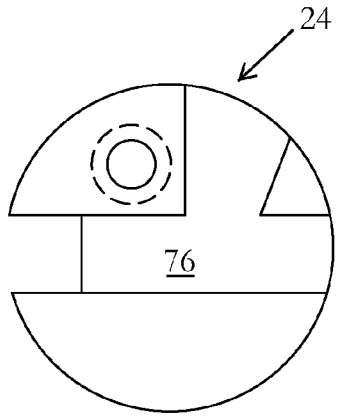

FIG. 3A-C shows an example embodiment of the second edge member (24). A through hole (52) with a countersink (56) is provided so that the cross member (38) can be inserted through the through hole, with the head (48) of the cross member (38) lying within the recess of the countersink (56). The countersink (56) prevents prying access to the head (48) of the cross member (38). FIGS. 7A-B show a variation of the L-shaped channel (26) where the body channel (28) is cut across the entire inner face (34), forming a Y-shaped channel (76). The Y shape is designed to accommodate laptop models with a screen that is hinged at a point inward from the back edge of the body, such that a portion of the body (104) extends behind the hinged joint (106), such as exemplified by the GOOGLE laptop designated as the CHROMEBOOK. Similarly, the screen channel (30) can be cut across the entire inner face (34) to form a T shape or an X shape, again to accommodate various laptop hinge designs.

An exploded view of the securement system (20) assembly is shown with a lock (200) and a portable device (100), namely a laptop. In this example embodiment, the user positions the second edge member (24) into engagement with the opposite screen edge (116) and opposite body edge (118), which is on the left side of the laptop in this example. The cross member (108) is inserted into the through hole (52') of the second edge member (24), with the head (48) preventing the cross member (38) from being completely pulled through. Alternatively, the second edge member (24) and the cross member (38) could be permanently connected. Thereafter, the user positions the first edge member (22) into engagement with the screen edge (110) and body edge (112), which is on the right side of the laptop in this example. The cross member (38) is inserted into the through hole (52) of the first edge member (22), such that the terminus of the cross member (38) protrudes from the outer face (36), or protrudes above the bottom of the recess (54). To prevent the retraction of the cross member (38), the user attaches a lock (200) to the terminus of the cross member (38). Because the cross member (38), in this case a rod (72), is just long enough to extend the width of the laptop with the edge members (22, 24), the securement system (20) cannot be removed until the user removes the lock (200).

Although the cross member (38) is shown as being located in the region above the top surface (126) of the body (104) and the front surface (120) of the screen (102), the cross member (38) could be located behind the back surface (124) of the screen (102) or under the bottom surface (130) of the body (104) in alternate embodiments. The through holes (52, 52') would be located accordingly to change the position of the cross member (38) relative to the portable device (100).

Figures 6A, 6B:
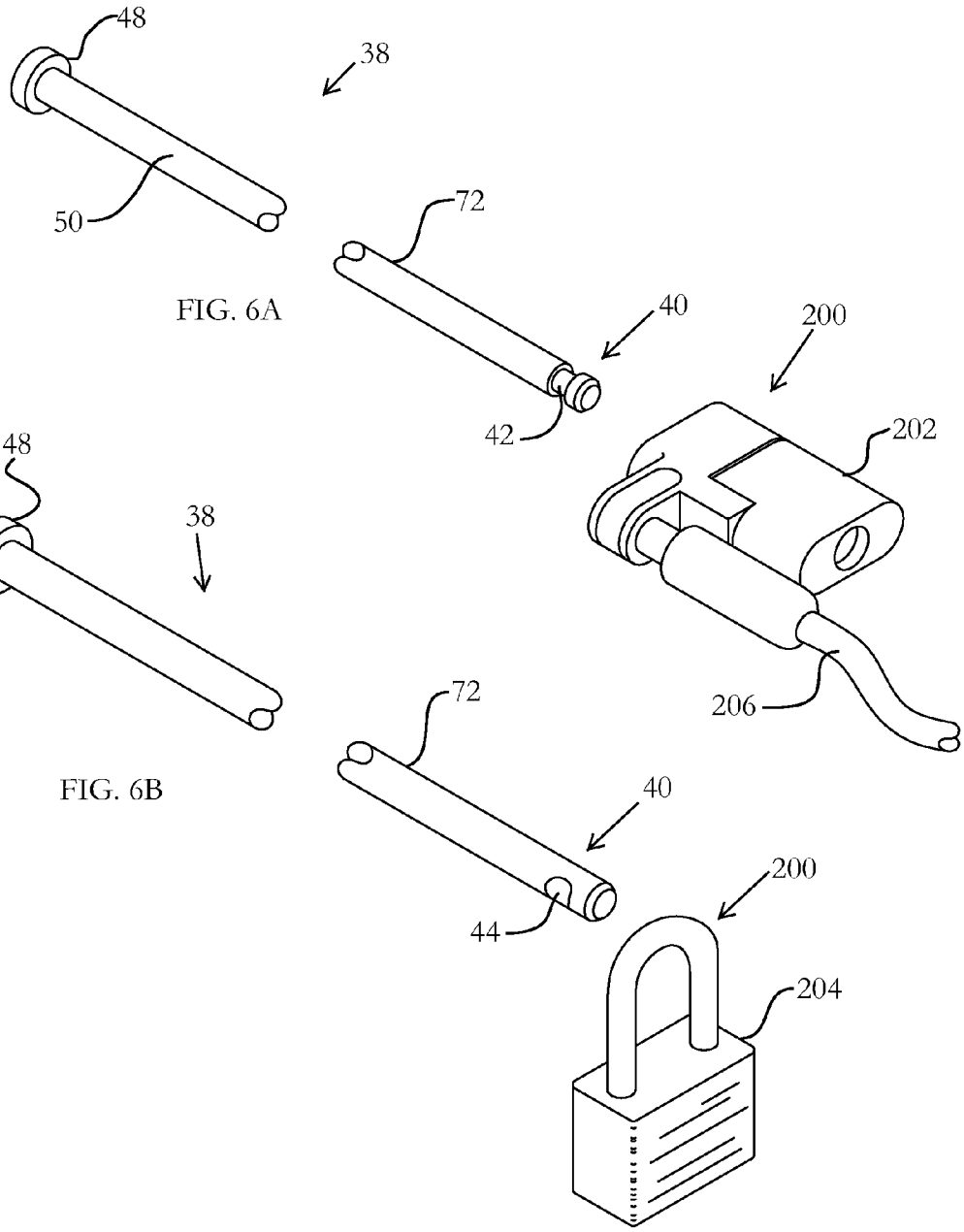
FIGS. 6A-B are exploded perspective views of the cross member of the present securement system with compatible locks.

A closer view of the cross member (38) and the lock (200) can be seen in FIGS. 6A-B. The cross member (38) is shown as a rod (72) with a round cross section. However, alternate cross sectional shapes can be used, such as a triangular cross section, or even a seven-sided or heptagonal cross section. If the cross sectional shape includes flat faces, then designs or messages can be printed on those faces. Preferably, a non-marring thermoplastic polymer coating (50) is applied to the exterior of the cross member (38) to prevent damage to the laptop finish. Alternatively, a plastic sleeve (not shown) may be fitted over the cross member (38).

The preferred material for the edge members (22, 24) is aluminum. The aluminum may be coated or surface treated, such as an anodizing process, to protect the aluminum from surface damage and to provide coloring. Alternatively, plastic material, such as high-density polyethylene, may be used to make the edge members (22, 24), provided the material is sufficiently tough to resist breakage and substantial bending. To provide additional strength, fiber reinforced plastics may also be employed, with glass, carbon, aramid, and other similar fibers.

The cross members (38) and two example locks (200) compatible with the present system (20) are shown in FIGS. 6A-B. The cross member (38) of FIG. 6A is configured to connect with a shaft retainer lock (202) with an internal clamshell gripping means that pinches down on the shaft within the annular groove (42), capturing the ferrule created by the annular groove (42) within the jaws of the clamshell gripper. This type of lock is sold by KENSINGTON and is known as the CLICKSAFE lock, which is also disclosed in U.S. Pat. Nos. 7,730,751, 7,963,132, 7,997,106, 8,001,812, 8,042,366, 8,230,707, U.S. App. Nos. 2012/0125057 and 2011/0072863, and U.S. Des. Patent Nos. D651,889, D660, 682, and D661,975. FIG. 6B shows a cross member (38) with a shackle hole (44) drilled perpendicular to the axis of the rod. The shackle hole (44) is configured to receive the shackle of a standard shackle lock (204), where the loop of a lanyard can be locked within the shackle for attachment to an anchor point (208).

Although not shown, yet another lock compatible with the present system (10) is a T-shaped rotating tee locking member or T-bar lock. This lock product is made by KENSINGTON and is known as the MICROSAVER lock, which is disclosed in U.S. Pat. Nos. 6,081,974, 6,317,936; 6,360,405, 7,204,106, 7,409,842 and U.S. App. Nos. 2011/0179834 and 2011/0122551.

The cross member (38) can be made of materials that resist substantial deformation, including bending and elongation. An example material could include hardened steel. If weight restrictions prohibit the use of steel, aluminum or reinforced plastic are alternate materials that provide sufficient resistance to deformation. Since laptop cases are made from plastic materials or thin metals, it is likely that the case or its hinge will be broken before a metal rod will substantially deform.

Figure 8C:
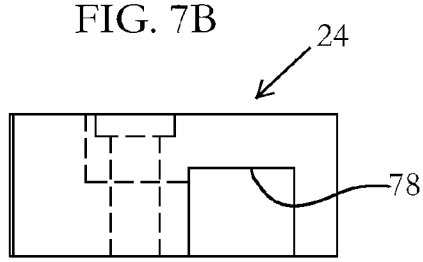
FIGS. 8A-C are perspective and orthographic views of alternate embodiments of the edge member of the present securement system.
Figure 8A:
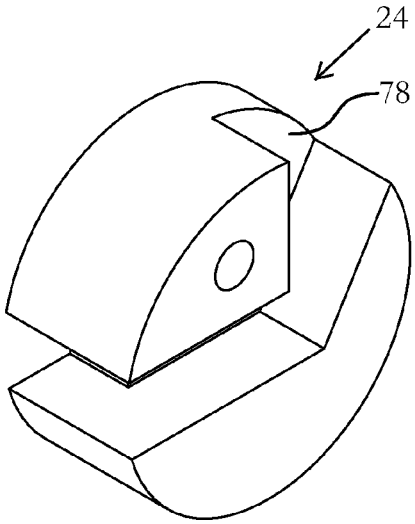
Figure 8B:
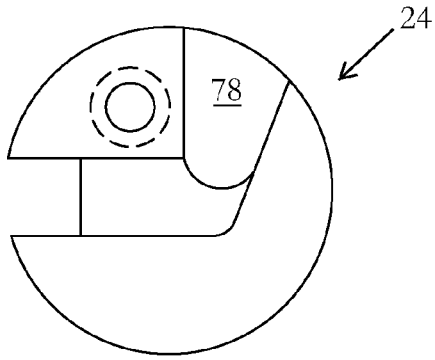

FIGS. 8A-C show an alternate embodiment where the vertical portion (60) includes a recessed portion (78) to accommodate movement of the screen (102). For example, if the horizontal portion (62) and the vertical portion (60) of the L-shaped channel were cut to the same depth, the screen (102) may rub or abrade the channel bottom of the vertical portion (60) when adjusting the viewing angle. The recessed portion (78) if cut at a slightly deeper depth than the horizontal portion (62) to provide clearance for the screen (102).

Yet another advantage of the present system (20) is that it maintains the portable device (100) in the open position when the secured mode. Often, when unauthorized persons attempt to move the portable device (100) in a theft attempt, the person will close the portable device (100) to hide and easily transport the device. The present system (20) does not permit an unauthorized person to close the portable device (100). So, even if the person were to cut or break the lanyard (206), the portable device (100) would remain open and difficult to hide.

While particular forms of the present securement system have been illustrated and described, it will also be apparent to those skilled in the art that various modifications can be made without departing from the spirit and scope of the design. Accordingly, it is not intended that the invention be limited except by the claims.

What is claimed is:

1. A system for securing a portable device having a screen connected to a body at a hinged joint, the screen having a screen edge and the body having a body edge, the system comprising:

an edge member having an L-shaped groove formed on an inner face, the L-shaped groove having a first wall, a second wall, and a bottom formed into a body of the edge member, the L-shaped groove configured to receive therein the screen edge within a vertical portion of the L-shaped groove and the body edge within a horizontal portion of the L-shaped groove when the screen is in the open position, the vertical portion having a width sufficient to permit the adjustment of the screen angle relative to the body;

a second edge member configured to engage an opposite edge of the portable device; and a cross member configured to selectively connect the edge member to the second edge member;

wherein a secured mode is effected when the edge member is engaged over the body edge and the screen edge when the screen is in the open position, the second edge member is engaged over the opposite edge, and the edge member is securely connected to the second edge member through the cross member, such that substantial separation of the edge member from the second edge member is prevented to substantially prohibit unauthorized removal of the system from the portable device.

2. The system of claim 1 wherein the cross member further comprises a lock attachment portion to prevent unauthorized disassembly of the system in the secured mode.

3. The system of claim 1 wherein the cross member is a rigid beam that substantially resists bending, such that an unauthorized person is prevented from substantially bending the cross member while attempting to dislodge either the edge member or the second edge member from the secured mode.

4. The system of claim 1 wherein the cross member is comprised of a rod with one of a round cross-section and a polygonal cross-section.

5. The system of claim 1 wherein the second edge member further comprises a second L-shaped groove formed on a second inner face, the second L-shaped groove configured to receive therein an opposite screen edge within a second vertical portion of the second L-shaped groove and an opposite body edge within a second horizontal portion of the second L-shaped groove when the screen is in the open position, the second vertical portion having a second width sufficient to permit the adjustment of the screen angle relative to the body.

* * * * *